United States Patent [19]

Bensen

[11] 4,392,260

[45] Jul. 12, 1983

[54] FLUSHING APPARATUS WITH SELECTIVE QUANTITY CONTROL

[76] Inventor: Court M. Bensen, 1250 Ralston St., Reno, Nev. 89503

[21] Appl. No.: 395,746

[22] Filed: Jul. 6, 1982

[51] Int. Cl.[3] ..... E03D 1/14; E03D 3/12

[52] U.S. Cl. ..... 4/324; 4/DIG. 3; 4/325; 4/249; 4/406

[58] Field of Search ..... 4/324, 325, 326, 249, 4/313, 406, 415, 405, 382, 392, 393, DIG. 3

[56] References Cited

U.S. PATENT DOCUMENTS

| | | | |
|---|---|---|---|
| 2,526,294 | 10/1950 | Stegeman | 4/325 |
| 2,532,977 | 12/1950 | White | 4/325 |
| 2,674,744 | 4/1954 | White | 4/249 |
| 2,813,274 | 11/1957 | Lewis et al. | 4/313 |
| 2,939,152 | 6/1960 | Wood | 4/325 |
| 3,108,286 | 10/1963 | Moore | 4/325 |
| 3,121,880 | 2/1964 | Gelhar | 4/249 |
| 3,156,930 | 11/1964 | Moulton et al. | 4/325 |
| 3,334,359 | 8/1967 | Weingartner | 4/325 |
| 3,380,077 | 4/1968 | Armstrong | 4/325 |
| 3,839,746 | 10/1974 | Kowalski | 4/325 |
| 3,908,204 | 9/1975 | Hopkins | 4/406 |
| 3,945,056 | 3/1976 | Kowalski | 4/325 |
| 3,969,775 | 7/1976 | Haselton | 4/325 |
| 4,014,050 | 3/1977 | Goldsworthy | 4/325 |
| 4,058,858 | 11/1977 | Che-Wei | 4/324 |
| 4,080,669 | 3/1978 | Biggerstaff | 4/325 |
| 4,141,091 | 2/1979 | Pulvari | 4/313 |

*Primary Examiner*—Henry K. Artis

*Attorney, Agent, or Firm*—Roylance, Abrams, Berdo & Farley

[57] ABSTRACT

A flush control apparatus includes a housing which replaces the usual tank top and has a chain extending down to the usual outlet valve member which is weighted to give it negative buoyancy. In the housing is a lever, motor, switch and timing circuit system which operates in response to actuation of one of two push buttons to lift the valve member for a predetermined interval of time, thereby determining an amount of flush water to be dispensed into the bowl.

3 Claims, 6 Drawing Figures

SOLID STATE RELAY
PS
FF
FF
+9v
12v
M
60
53
61
22
17
66
67
68
69
70
71
72
73
74
76
77
78
79
80
82
83
84
15
16
90
91
92
93

FLUSHING APPARATUS WITH SELECTIVE QUANTITY CONTROL

This invention relates to an apparatus for controlling the amount of water dispensed from a storage tank to flush a toilet and, in particular, for permitting selection of two or more quantities of flushing water to be dispensed without regard to the water level in the tank.

BACKGROUND OF THE INVENTION

It is now well recognized that it is important to conserve water and that toilet flushing in the home is a major user of fresh water. Further, it is well known that a "normal" quantity of flush water, e.g., on the order of 4 gallons, or, in newer units, 3.5 gallons, is sometimes necessary to adequately empty the waste material but that a greatly reduced amount of water, e.g., 1 to 1.5 gallons, is quite adequate under some circumstances which need not be described in detail.

With this knowledge, various efforts have been made to develop an apparatus capable of selectively dispensing one of two or more possible quantities of water from the amount available in the usual storage tank. Following are U.S. Patents illustrating the diverse paths taken to achieve a goal somewhat similar to that described above and, in some cases, identical: Nos.

2,526,294: Stegeman
2,532,977: White
2,674,744: White
2,813,274: Lewis et al.
2,939,152: Wood
3,108,286: Moore
3,121,880: Gelhar
3,156,930: Moulton et al.
3,334,359: Weingarten
3,380,077: Armstrong
3,839,746: Kowaiski
3,908,204: Hopkins
3,945,056: Kowaiski
3,969,775: Haselton
4,014,050: Goldsworthy
4,058,858: Liao Che-Wei
4,080,669: Biggerstaff
4,141,091: Pulvari Scrutiny of the above will reveal that each attempt to solve the problem suffers from one or more of several shortcomings, including (a) requiring that a significant portion of the mechanism within the tank be either replaced or greatly modified (b) employing techniques which are marginally workable, at best, and which can be expected to be unreliable after a very short time because of the water immersion of the components (c) using devices such as compression coil springs which are known to have a short life in a tank or (d) in the case of electricity operated devices, placing current-carrying components in a position which presents a possible shock hazard.

While modification of the tank-contained valve operating mechanism is not, in itself, necessarily undesirable, the fact is that most homeowners hesitate to materially alter a flushing apparatus which works well, however wastefully, and manufacturers hesitate to modify and sell a system which has found wide market acceptance and has been proven reliable.

BRIEF DESCRIPTION OF THE INVENTION

Accordingly, an object of the present invention is to provide a flushing control apparatus which can easily be added to an existing toilet without altering the existing mechanical apparatus and which permits selectively dispensing either of two quantities of flushing water from the storage tank.

A further object is to provide such an apparatus which is electrically operated and wherein all current-carrying electrical components are safely isolated.

Briefly described, the invention includes an apparatus for selectively dispensing either of two predetermined quantities of flushing water from the storage tank of a toilet of the type having an opening in the bottom thereof through which flushing water passes, a valve member operable to open and close the opening, the valve member normally exhibiting a net positive buoyant force in water when removed from the opening, and upwardly extending means for operating the valve member by lifting it away from the opening, the apparatus comprising weight means attached to said valve member for changing the buoyancy thereof from positive to negative; motor means coupled to said means for operating, said motor means being operative, when energized, to exert an upward force on said means for operating to lift said valve member away from said opening, to hold said valve member in the lifted position against the downward force of said weight means, and to lower said valve member to its closed position without regard to the water level in the storage tank; housing means for supporting said motor means above the water in said tank; timing means for selectively producing energizing signals for said motor means in pairs to lift and lower said valve member, the leading edges of the signals in one said pair being separated by a first time interval and the leading edges of the signals in a second said pair being separated by a second, longer time interval; and manually operable switch means for selecting one of said signal pairs, thereby selecting the interval said valve member is held in the open position.

In order that the manner in which the foregoing and other objects are attained in accordance with the invention can be understood in detail, particularly advantageous embodiments thereof will be described with reference to the accompanying drawings, which form a part of this specification, and wherein.

DETAILED DESCRIPTION OF A PREFERRED EMBODIMENT

Figure 1:
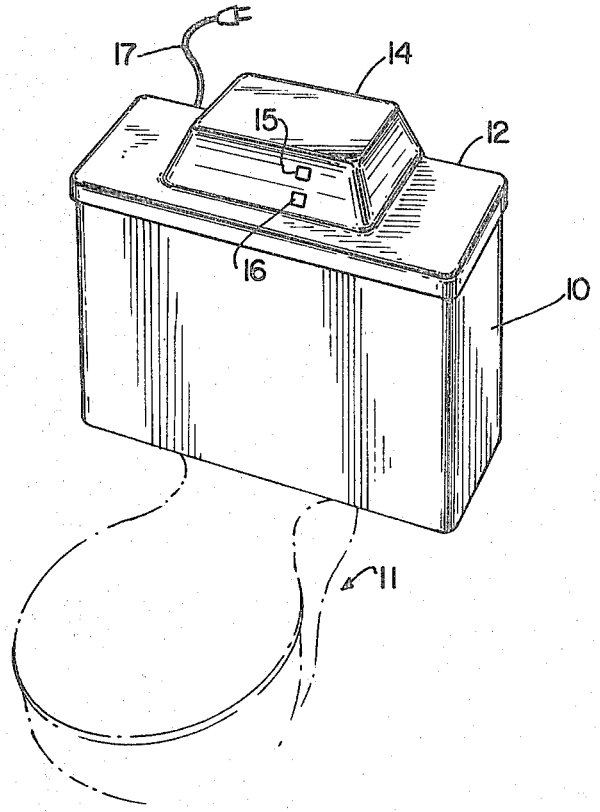
FIG. 1 is a perspective view of a conventional toilet with an apparatus in accordance with the present invention added thereto.

FIG. 1 is a perspective view of a conventional toilet with the flushing apparatus in accordance with the present invention mounted thereon. As usual, the toilet includes a water storage tank 10 which has a bottom opening connected to a bowl indicated generally at 11, the bowl and tank being quite conventional. The tank normally has a lid which is ceramic and which simply rests on the upper edge of the tank, closing its open top.

The present invention includes a housing structure 12 which is made of an electrically nonconductive, polymeric material shaped to cover and conform to the upper edge of tank 10, completely replacing the original cover. The housing at 12 is a hollow body and, in the embodiment shown, has relatively shallow or thin side portions and a deeper or thicker central portion 14 which contains the working components of the present invention, to be described in greater detail. Of particular significance in FIG. 1 is the provision of first and second manually operable switch means 15 and 16 which are mounted in and protrude through, in a conventional fashion, openings provided in portion 14 of housing 12. As will be described in detail, when the device is connected for operation, one of switches 15, 16, can be operated to provide a "normal" or high volume flush, and the other switch can be operated to provide a reduced volume flush. Switches 15, 16 are preferably push-button switches and can be of an internally illuminated type so that the actuated switch lights up when pushed and remains lighted until completion of the flushing cycle. Also, as shown in FIG. 1, a conventional power cord 17 with a plug at the end thereof extends out of the housing to be plugged into any conventional electrical outlet.

Figure 2:
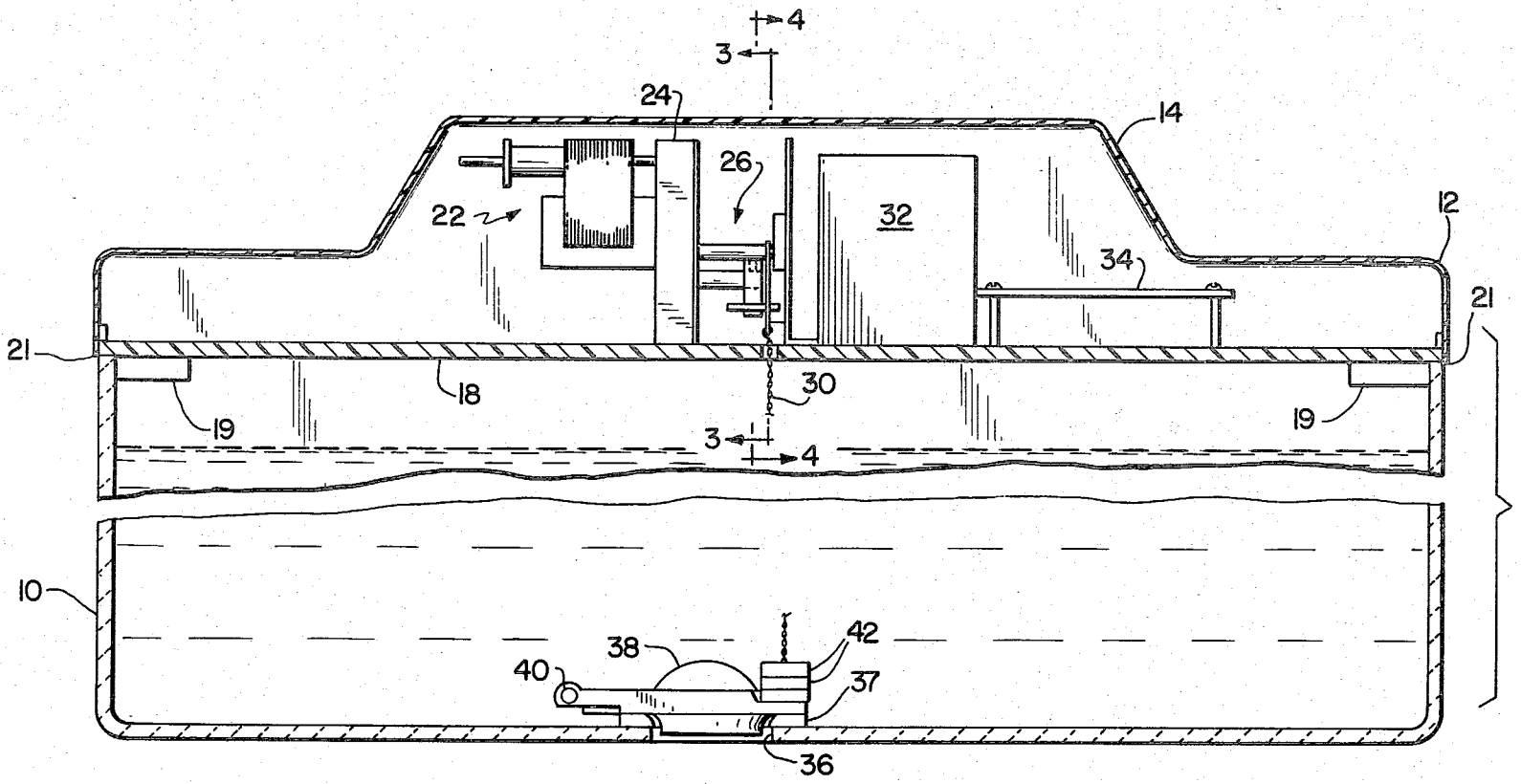
FIG. 2 is a foreshortened front elevation, in partial section, of an apparatus in accordance with the invention showing the general arrangement of parts.

The apparatus of the present invention is more clearly shown in the sectional views of FIGS. 2–5. As seen in FIG. 2, the housing 12 includes a flat plastic panel 18 which lies across the top of tank 10, resting on the upper edges thereof. Positioning blocks 19 can be adhered to the under surface of panel 18 to position it on the top of the tank. The upper shell of housing 12, which is preferably moulded from a single sheet of polymeric material, has downwardly extending peripheral edges 21 which can engage the upper edges of the tank.

Figure 3:
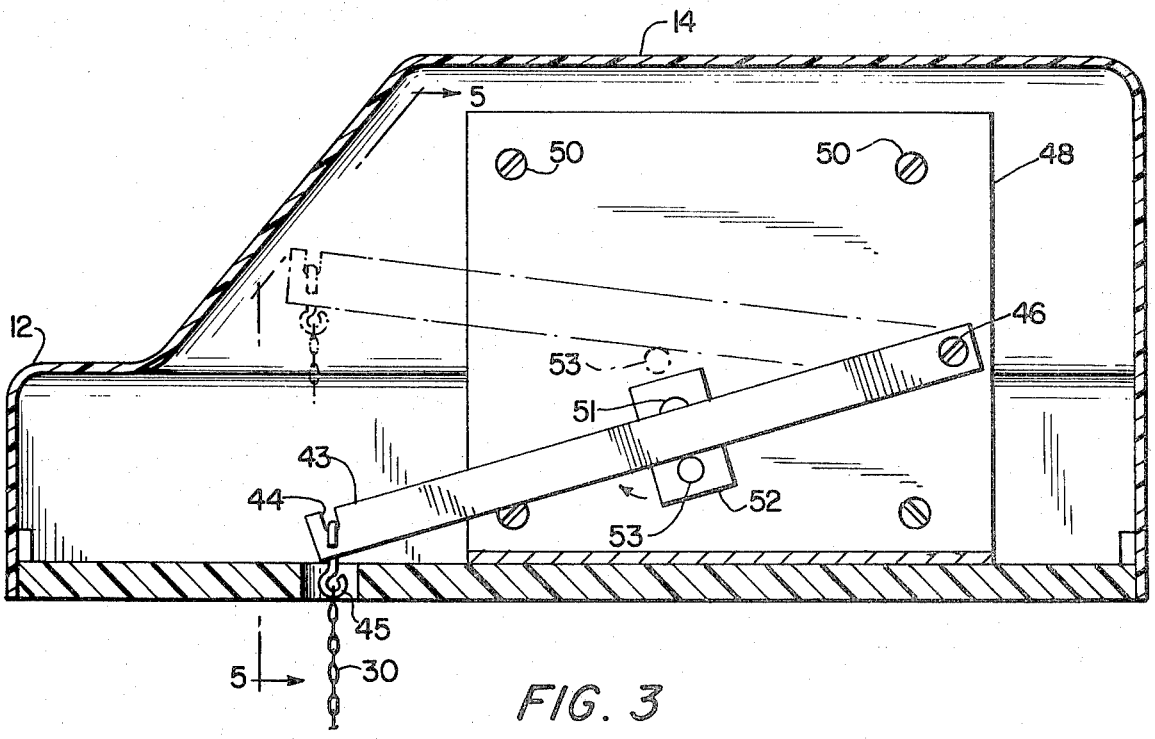
FIG. 3 is a right side elevation, in partial section of the apparatus of FIG. 2.
Figure 4:
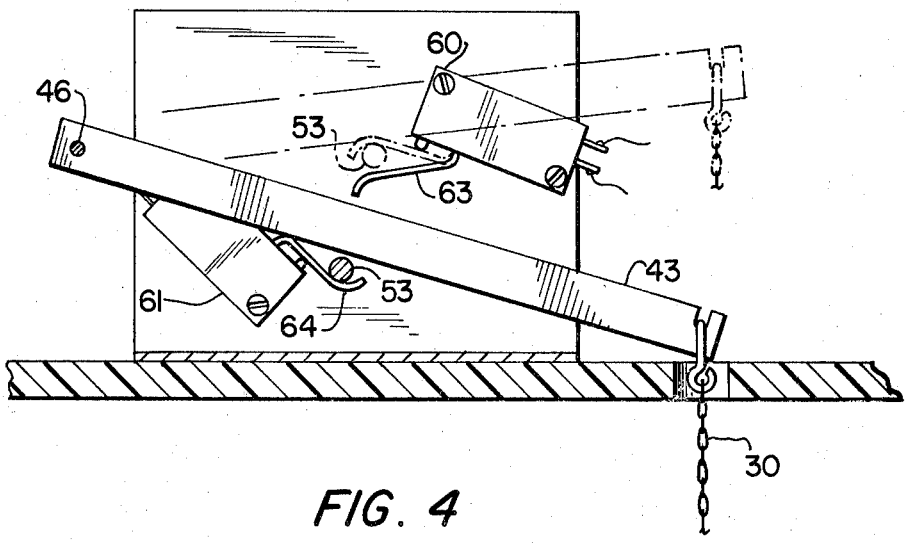
FIG. 4 is a partial left side elevation, in partial section, of the apparatus of FIGS. 2 and 3.
Figure 5:
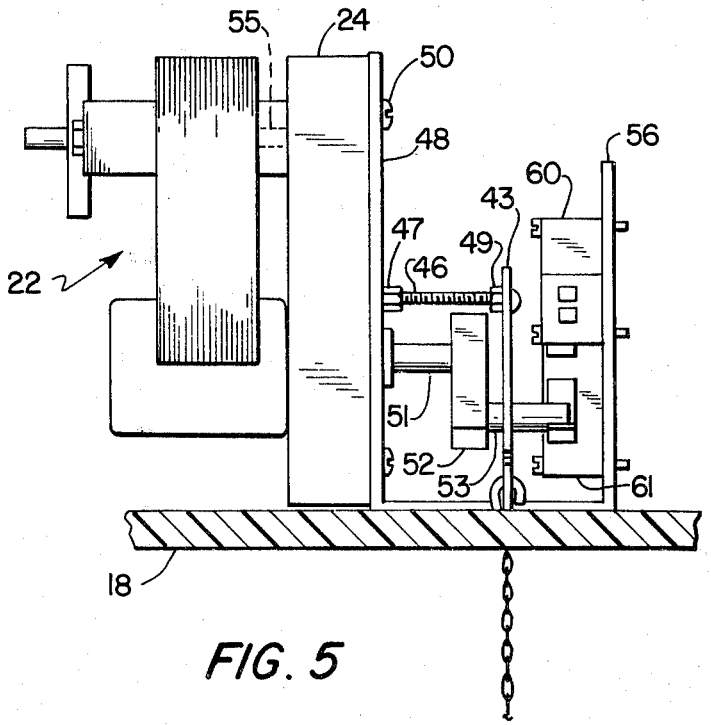
FIG. 5 is an enlarged partial front elevation of the apparatus of FIGS. 3 and 4 showing portions thereof in greater detail.

The hollow interior of the housing contains various components, the general arrangement of which is shown in FIG. 2, but the detailed relationships of which are more clearly and accurately shown in FIGS. 3, 4, and 5. These components include a rotary motor indicated generally at 22, which has an output shaft extending into a gear box 24. The output shaft of the gear box drives a switch mechanism indicated generally at 26 and operates a lever which can exert a lifting force on a pull chain 30. Chain 30 is representative of a variety of different kinds of valve actuating mechanisms which can be used to operate the valve provided at the bottom of the tank. The housing also includes a transformer 32 and a printed circuit board 34, the transformer being connected to power cord 17 and the printed circuit board being provided to hold various circuit components used in the operation and control of the apparatus, particularly the timing circuit. No effort has been made to depict the transformer or printed circuit components in any realistic detail since the arrangement and selection thereof is subject to wide variation.

As illustrated in FIG. 2, the bottom of tank 10 is provided with an opening 36 through which water can pass to the toilet bowl 11. A ring 37 is conventionally provided to form a valve seat, this ring also being sometimes used as a mechanical coupling member. A valve member 38 is pivotally mounted as illustrated by the pivot pin 40 so as to be moveable between the closed position illustrated in solid lines and an open position partially indicated in a phantom lines. Chain 30 is attached to valve member 38 at the end of the valve opposite the pin 40 so that, when an upward pull is exerted on chain 30, the valve is opened. In a conventional manually operated flushing apparatus, the upper end of chain 30 is coupled to a lever connected to a manually operated handle, and valve member 38 is formed to have an air space so that it exhibits positive buoyancy. Thus, as soon as the handle is operated to lift the valve member away from opening 36 and ring 37, and assuming that the tank is initially full of water, this positive buoyancy force keeps the valve open until the water level falls below the lower edge of the valve member whereupon the valve member closes. Thus, by the time the valve closes, substantially all of the water has been dispensed from the tank.

In accordance with the present invention, the valve structure is provided with a plurality of weights 42 in the form of annular bodies similar to washers made of a relatively heavy, preferably non-corrosive material such as brass or lead. The purpose of weights 42 is to change the buoyancy characteristics of the valve member from positive to negative so that the valve member will close any time that an upward pull is not exerted on chain 30. Normally, a few ounces to about one-half pound of weight is adequate to perform this function. It is quite important to provide this weight so that the closure of valve member 38 is no longer dependent upon the level of water in the tank.

It should be pointed out, at this stage, that the specific nature of the valve used in the tank is not important. Many tanks employ valves of the type having a sliding upwardly extending rod which passes through a fixed guide, such as generally illustrated in previously mentioned U.S. Pat. No. 3,334,359. In such a case, weight is added surrounding the rod. The principle does not change, however, because in a mechanism of that type the rod is coupled to the usual handle, in the original installation, by a chain or by a link which is slidable with respect to the rod so that the handle exerts upward force but no downward force thereon.

The lifting and switching mechanism is shown in greater detail in FIGS. 3–5 and includes a lever 43 having a notch 44 at one end to receive a hook 45 which connects chain 30 to the lever. The other end of lever 43 is pivotally mounted on a machine screw 46 which is threaded into a nut 47 attached to a mounting bracket 48 supported on plate 18. As will be seen in FIG. 5, a nut loosely retains lever 43 between itself and the head of screw 46. Thus, the lever is free to pivot about the axis of screw 46 between the positions illustrated in solid and phantom lines in FIGS. 3 and 4.

Gear box 24 is supported on bracket 48 by screws 50. The output of the gear box is a shaft 51 which has a block 52 fixedly attached thereto and rotatable therewith. Block 52, in turn, has a pin 53 extending therefrom, the pin and block constituting a crank arm rotatable about the axis of pin 51. As will be seen in FIG. 5, pin 53 extends beneath lever 43 so that the lever rests on the pin and, as the output shaft, block and pin rotate in the direction of the arrow in FIG. 3, the pin 53 moves from the solid line to the phantom line position, elevating the lever and exerting an upward pull on chain 30.

The input to gear box 24 is from motor 22 which has an output shaft 55 extending directly into the gear box. The motor is a conventional A.C. motor of any convenient type, the gear box being selected to reduce the rotational speed from that of the motor and increase the torque mechanical advantage for operation of the lever mechanism.

A bracket wall 56, which can be unitarily formed with bracket 48, is parallel with bracket 48 and spaced therefrom and supports first and second limit switches 60 and 61. Switches 60 and 61 are of the "microswitch" type, each switch having an actuating button operated by a lever. As seen in FIG. 4, switch 60 has a lever 63 and switch 61 has a lever 64, each lever being resilient, the switches being positioned so that as pin 53 rotates about its circular path, it engages lever 64 near its lowest position and lever 63 near its highest position, operating the respective switches at those extremes.

The operation of the apparatus can be briefly described by assuming, first, that tank 10 is filled with water up to the usual operating level, and that pin 53 is in the position approximately shown in FIGS. 3, 4, and 5 such that the contacts of switch 61 are closed. Operation of one of switches 15 and 16 then provides a signal to motor 22 to cause the motor to rotate, moving pin 53 through an arc of approximately 180° until it operates lever 63 and closes the contacts of switch 60. This provides a signal which interrupts the energization of the motor, stopping the rotation of shaft 51. At this point, pin 53 is approximately in its highest position, as is lever 43. Thus, valve member 38 is elevated to open the bottom opening 36 of the tank, dispensing flushing water. This condition persists for an interval of time determined by timing circuitry on printed circuit board 34, after which the motor 22 is again energized, permitting the crank arm 52, 53 to rotate to its original position in which switch 61 is again actuated, again providing a signal which interrupts the energization of motor 22, stopping the motor with lever 43 in its lowest position in which valve member 38 is again in the closed position. Again, it will be observed that, because of weights 42, valve 38 is allowed to close whenever lever 43 is lowered without regard to the amount of water remaining in tank 10. This permits the open interval of valve 38, 37 to be determined entirely by the motor, switch mechanism, and timing circuitry. The time interval can, thus, be determined by which of switches 15 or 16 is initially operated.

Figure 6:
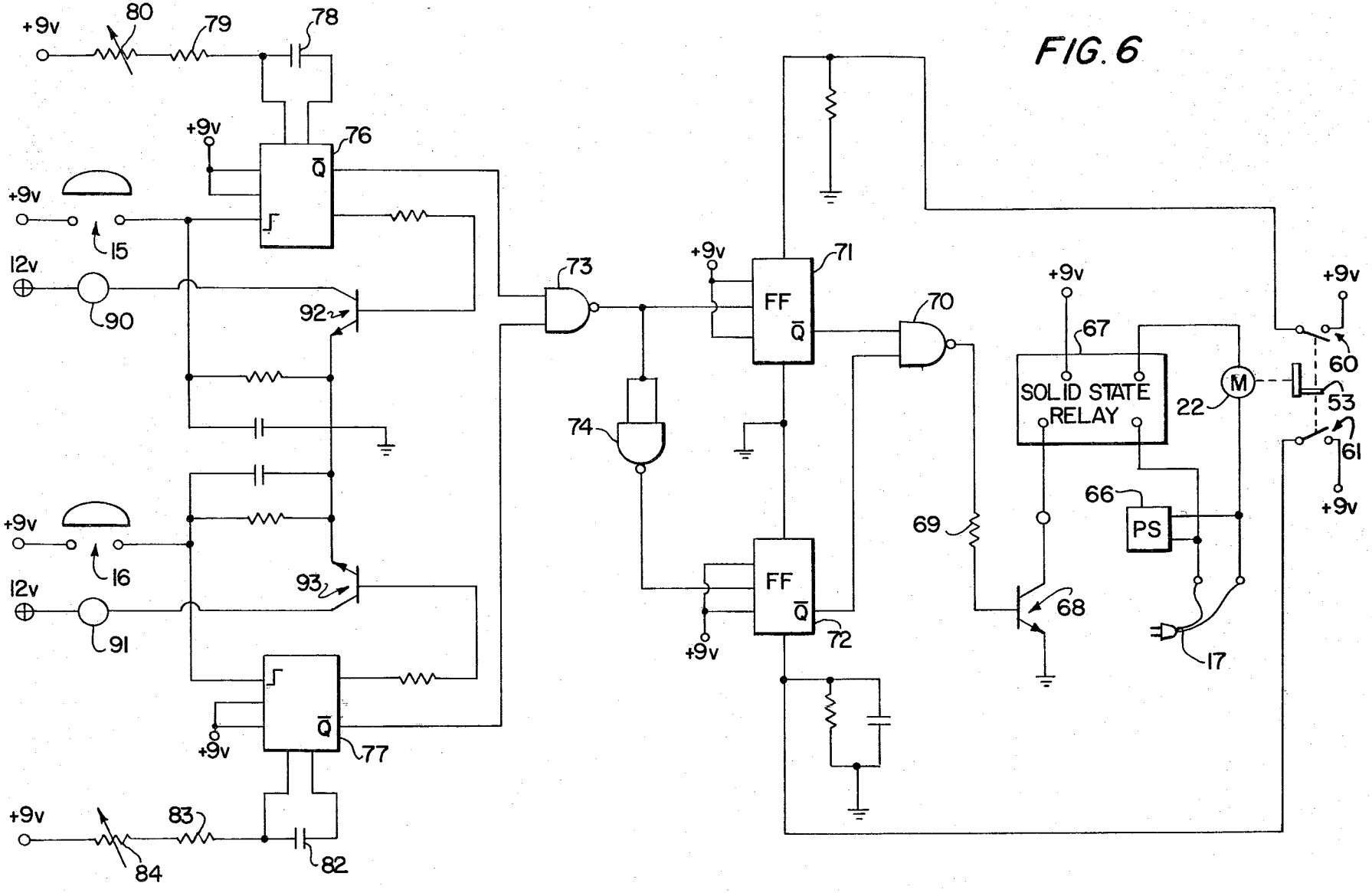
FIG. 6 is a schematic circuit diagram of a timing and control circuit usable in the apparatus of FIGS. 1–5.

FIG. 6 shows one embodiment of a timing circuit which can be employed in conjunction with the present invention. As seen at the right of this figure, switches 60 and 61 are manually actuated by pin 53 which is driven by motor 22. The motor, in turn, is connected to an AC source through line cord 17 and is in series with the switchable output circuit of a conventional solid state relay 67. The input terminals of the solid state relay are connected to a nine volt D.C. supply and to a control input terminal which is coupled to the collector-emitter circuit of a switching transistor indicated generally at 68. It will be noted that the AC supply is also connected to a power supply unit 66 which is a conventional transformer-rectifier type of supply designed to supply either 9 or 12 volts DC as required by various circuit components employed.

The base of transistor 68 is connected through a resistor 69 to the output of a NAND gate 70 which has two inputs, one from a bistable circuit 71 and the other from a similar bistable circuit 72. These circuits are conventional JK flip-flop circuits, the outputs connected to the inputs of NAND gate 70 being the inverted outputs from those circuits.

The input to bistable circuit 71 is the output of a NAND gate 73, and the input to bistable circuit 72 is the inverted output of gate 73, inverted by a NAND gate 74 with both inputs coupled together. The JK inputs of bistable circuits 71 and 72 are connected to a DC supply. The inputs to gate 73 are the inverted outputs of monostable circuits 76 and 77, respectively. Monostable circuit 76 has an unstable interval which is determined by the time constant of an external circuit including a capacitor 78, a fixed resistor 79 and an adjustable resistor 80, the resistance of which is variable to provide an adjustable unstable interval for the circuit of about 3 to about 13 seconds. Similarly, monostable circuit 77 is provided with a time delay determined by a capacitor 82, a fixed resistor 83 and a variable resistor 84 to determine an adjustable unstable interval in the order of from one to six seconds. The inputs to circuits 76 and 77 are supplied by contact sets associated with switches 15 and 16, respectively. Thus, closing switch 15, for example, provides a positive-going input to monostable circuit 76, the inverted output of which causes the output of NAND circuit 73 to drop. This signal, inverted by gate 74 causes bistable circuit 72 to change state, creating an output from gate 70 which renders transistor 68 conductive, activating the solid state relay 67 and energizing motor 22. As soon as the motor has rotated shaft 51 through an angle of 180°, pin 53 closes switch 60 which supplies a reversing input to bistable circuit 71, reversing the output of gate 70 and deenergizing the solid state relay. This deenergizes motor 22, and pin 53 remains in its "high" position, permitting water to flow out of tank 10.

At the end of the unstable state of monostable circuit 76, the signal is again reversed, changing the state of bistable circuit 71 and again energizing the motor, causing rotation through a further 180°, permitting pin 53 to come in contact with lever 64 of switch 61. This supplies a signal to bistable circuit 72, again changing the input to gate 70 and deactivating transistor 68 and the solid state relay and deenergizing motor 22 with pin 53 in its "low" position. In this position, lever 43 is also low and the valve member is in its closed position, terminating flow.

The operation of the circuit by actuation of switch 16 is the same except that the time interval is determined by the unstable interval of circuit 77 rather than circuit 76.

As shown, the circuit of FIG. 6 also includes lamps 90 and 91 which are driven by transistor switches 92 and 93, respectively, when the associated one of switches 15 and 16 is operated. These are simple lamp driver circuits and need not be described further. It is convenient to incorporate lamps within the translucent bottom portions of commonly available switches, as mentioned above, so that the user will immediately know that he has initiated actuation of the system.

While one advantageous embodiment has been chosen to illustrate the invention, it will be understood by those skilled in the art that various changes and modifications can be made therein without departing from the scope of the invention as defined in the appended claims.

What is claimed is:

1. An apparatus for selectively dispensing either of two predetermined quantities of flushing water from the storage tank of a toilet of the type having an opening in the bottom thereof through which flushing water passes, a valve member operable to open and close the opening, the valve member normally exhibiting a net positive buoyant force in water when removed from the opening, and upwardly extending means for operating the valve member by lifting it away from the opening, the apparatus comprising weight means attached to said valve member for changing the buoyancy thereof from positive to negative;

motor means coupled to said means for operating, said motor means being operative, when energized, to exert an upward force on said means for operating to lift said valve member away from said opening, to hold said valve member in the lifted position against the downward force of said weight means, and to lower said valve member to its closed position without regard to the water level in the storage tank;

housing means for supporting said motor means above the water in said tank;

timing means for selectively producing energizing signals for said motor means in pairs to lift and lower said valve member, the leading edges of the signals in one said pair being separated by a first time interval and the leading edges of the signals in a second said pair being separated by a second, longer time interval; and manually operable switch means for selecting one of said signal pairs, thereby selecting the interval said valve member is held in the open position.

2. An apparatus according to claim 1 wherein said motor means comprises a motor having a rotatable output shaft;

a crank coupled to said shaft and rotatable through a circle;

a lift lever pivotally connected at one end to said housing means, the other end of said lift lever being coupled to said upwardly extending means for operating said valve member, said lift lever extending across and above said crank so that said lever is lifted and lowered as said crank rotates through said circle;

first and second limit switches; and means in said housing means for mounting said switches for actuation by said crank and lift lever movement so that said first one of said switches is actuated when said lever is in a high position and the second of said switches is actuated when said lever is in a low position;

and wherein said timing means is connected to supply the first signal of a pair of signals through said first limit switch to said motor and the second signal of said pair through said second limit switch.

3. An apparatus according to claim 2 wherein said housing means comprises a hollow housing of electrically nonconductive polymeric material shaped to engage and cover the open top of a toilet storage tank, thereby replacing the original cover thereof, and means defining openings through an exposed surface of said housing to receive said manually operable switch means.

* * * * *